US011646525B2

(12) United States Patent
Oomori et al.

(10) Patent No.: US 11,646,525 B2
(45) Date of Patent: May 9, 2023

(54) CONNECTOR HAVING SEAL MEMBER

(71) Applicant: SUMITOMO WIRING SYSTEMS, LTD., Mie (JP)

(72) Inventors: Ryo Oomori, Mie (JP); Masakazu Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/503,698

(22) Filed: Oct. 18, 2021

(65) Prior Publication Data

US 2022/0131309 A1 Apr. 28, 2022

(30) Foreign Application Priority Data

Oct. 23, 2020 (JP) ..... JP2020-177725

(51) Int. Cl.
*H01R 13/627* (2006.01)
*H01R 13/52* (2006.01)

(52) U.S. Cl.
CPC ..... *H01R 13/5205* (2013.01); *H01R 13/6272* (2013.01)

(58) Field of Classification Search
CPC ..... H01R 13/5205; H01R 13/6272
See application file for complete search history.

(56) References Cited

U.S. PATENT DOCUMENTS

| | | | | |
|---|---|---|---|---|
| 6,152,752 | A | 11/2000 | Fukuda | |
| 6,575,788 | B2 | 6/2003 | Nimura et al. | |
| 8,545,264 | B2 * | 10/2013 | Nawa | H01R 13/5208 439/587 |
| 9,124,016 | B2 * | 9/2015 | Omori | H01R 13/422 |
| 10,644,435 | B2 * | 5/2020 | Oomori | H01R 13/5213 |

FOREIGN PATENT DOCUMENTS

JP 2001068208 A * 3/2001 ..... H01R 13/5205

* cited by examiner

*Primary Examiner* — Tho D Ta
(74) *Attorney, Agent, or Firm* — Venjuris, P.C.

(57) ABSTRACT

A connector 10 includes a terminal fitting 11, a housing 12, a seal member 13 and a mounting member 14. The terminal fitting 11 is connected to a wire 80. The seal member 13 includes a seal hole 52 through which the wire 80 is passed in a liquid-tight manner. The mounting member 14 holds the seal member 13 by sandwiching the seal member 13 between the housing 12 and the mounting member 14. The mounting member 14 is in contact with the seal member 13 and movably mounted on the housing 12.

6 Claims, 9 Drawing Sheets

CONNECTOR HAVING SEAL MEMBER

CROSS-REFERENCE TO RELATED APPLICATIONS

This application is based on and claims priority from Japanese Patent Application No. 2020-177725, filed on Oct. 23, 2020, with the Japan Patent Office, the disclosure of which is incorporated herein in their entireties by reference.

TECHNICAL FIELD

The present disclosure relates to a connector.

BACKGROUND

Japanese Patent Laid-open Publication Nos. 2000-133367 and 2002-305052 discloses a connector provided with a seal member, through which a wire is passed. The connector of Japanese Patent Laid-open Publication No. 2000-133367 includes a housing (inner housing), an outer housing, a spacer and a seal member (waterproof rubber plug). The housing is arranged inside the outer housing and locked to the outer housing. The spacer is arranged between the housing and the outer housing and locked to the outer housing. The seal member is held by being sandwiched by the spacer and the outer housing.

The connector of Japanese Patent Laid-open Publication No. 2002-305052 includes a housing, a receptacle and a seal member (rubber plug). The seal member is fit into a rubber plug accommodation chamber formed in the rear surface of the housing and prevented from coming out by the receptacle locked to the housing.

SUMMARY

In a connector of this type, it is preferred that the vibration of a wire is not transmitted to a housing. However, in the connector of Japanese Patent Laid-open Publication No. 2000-133367, the housing (inner housing) and the spacer are respectively locked to the outer housing not to be relatively displaced. Thus, the vibration of the wire is transmitted to the housing without being attenuated via the spacer and the outer housing holding the seal member. Also in the connector of Japanese Patent Laid-open Publication No. 2002-305052, the housing is locked to the receptacle not to be relatively displaced. Thus, the vibration of the wire is transmitted to the housing without being attenuated via the seal member.

Accordingly, the present disclosure aims to provide a technique capable of suppressing the vibration of a wire to be transmitted to a housing.

The present disclosure is directed to a connector with a terminal fitting to be connected to a wire, a housing for accommodating the terminal fitting, a seal member including a seal hole, the wire being passed through the seal hole in a liquid-tight manner, and a mounting member for holding the seal member by sandwiching the seal member between the housing and the mounting member, the mounting member being in contact with the seal member and movably mounted on the housing.

According to the present disclosure, it is possible to suppress the vibration of a wire to be transmitted to a housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
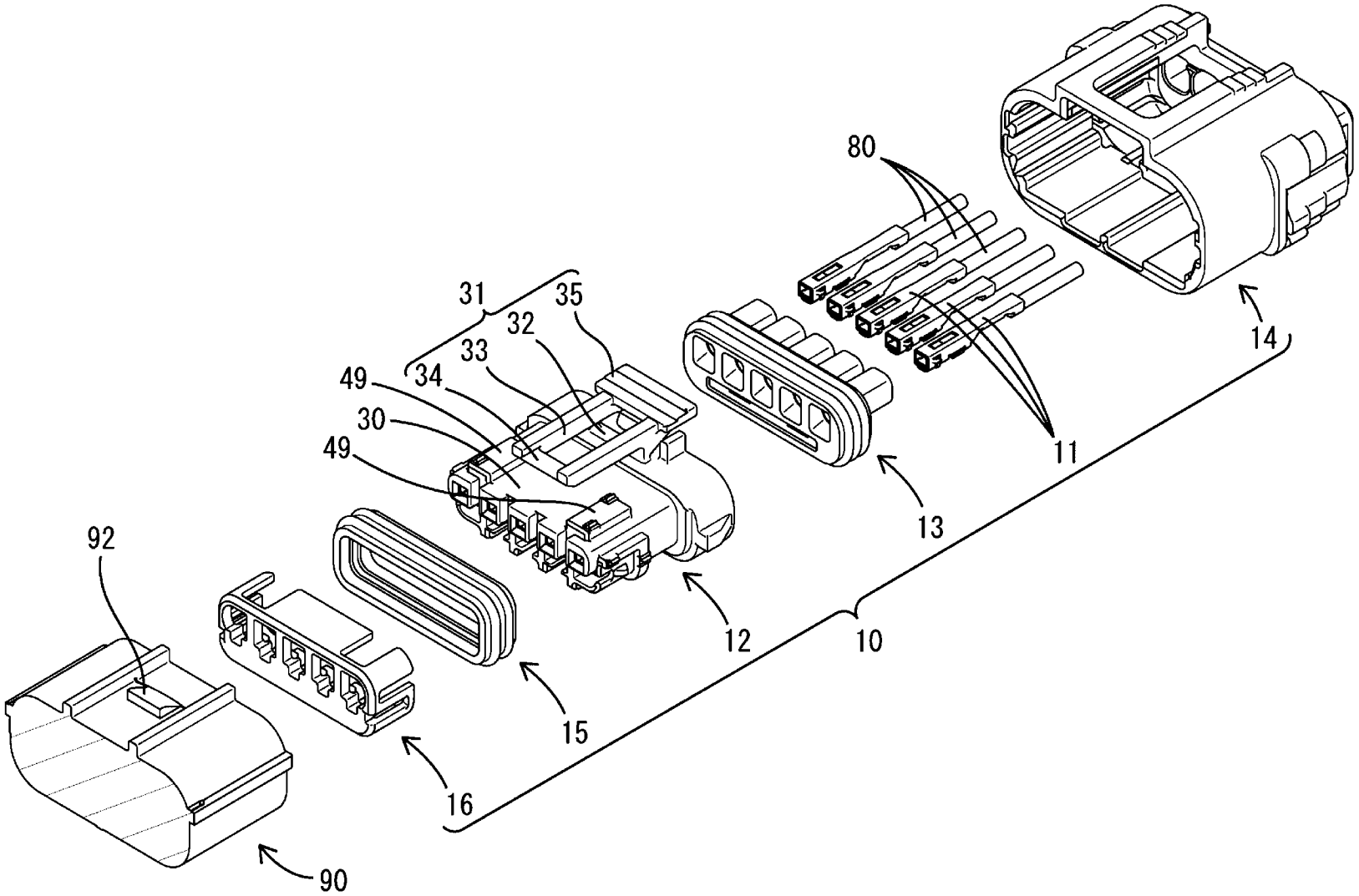
FIG. 1 is an exploded perspective view of a connector of one embodiment and a mating connector.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector of the present disclosure includes a terminal fitting to be connected to a wire, a housing for accommodating the terminal fitting, a seal member including a seal hole, the wire being passed through the seal hole in a liquid-tight manner, and a mounting member for holding the seal member by sandwiching the seal member between the housing and the mounting member, the mounting member being in contact with the seal member and movably mounted on the housing.

In this connector, since the mounting member is in contact with the seal member, the vibration of the wire passed through the seal member is transmitted to the mounting member via the seal member. However, since the mounting member is movable with respect to the housing, the vibration transmitted to the mounting member is less likely to be transmitted to the housing. Therefore, the vibration of the wire can be released to the mounting member, with the result that the vibration of the wire to be transmitted to the housing can be suppressed.

(2) Preferably, the seal member includes a tube portion, the seal hole is formed in the tube portion, and the mounting member includes a through hole to be held in contact with an outer peripheral surface of the tube portion.

According to this configuration, a vibration force of the wire can be efficiently transmitted to the mounting member via the tube portion. Thus, the vibration of the wire to be transmitted to the housing via the seal member is reduced. Further, the vibration transmitted to the mounting member via the tube portion is less likely to be transmitted to the housing as described above. Therefore, the vibration of the wire to be transmitted to the housing can be further suppressed.

(3) Preferably, the housing includes a lock arm on a side surface of an outer periphery, the lock arm locking a mating connector in a connected state, the member includes an outer wall for covering the side surface of the housing, and the outer wall includes an opening for exposing the lock arm and protection walls arranged on both sides across the opening to cover the lock arm from the both sides.

According to this connector, the lock arm is less likely to interfere with external mattes due to the protection walls of the mounting member. Thus, for example, the lock arm can be prevented from being inadvertently released.

(4) Preferably, the housing includes a locking portion, and the seal member includes a lock receiving portion for restricting separation of the seal member from the housing by being locked by the locking portion.

According to this connector, relative positions of the seal member and the housing can be prevented from changing when the mounting member moves with respect to the housing.

(5) Preferably, the housing includes an engaging portion, the mounting member includes an engagement receiving portion, and at least one of the engaging portion and the engagement receiving portion is deflectable and deformable during vibration of the wire.

According to this connector, since at least one of the engaging portion and the engagement receiving portion is deflected and deformed during the vibration of the wire, the vibration is less likely to be transmitted between the engaging portion and the engagement receiving portion. Therefore, the vibration transmitted to the mounting member via the seal member is even less likely to be transmitted to the housing, with the result that the vibration of the wire to be transmitted to the housing can be further suppressed.

(6) Preferably, the mounting member includes a rear wall for sandwiching the seal member between the housing and the rear wall, the rear wall has, on a front surface, a seal restricting surface for restricting a rearward displacement of the seal member and a housing restricting surface for restricting a rearward displacement of the housing, and the housing restricting surface is arranged rearward of the seal restricting surface.

According to this configuration, if the mounting member is inclined with respect to the housing, for example, due to the vibration of the wire, the housing restricting surface can restrict a rearward displacement of the housing. Thus, it can be suppressed that the mounting member and the housing come any further closer. As a result, excessive compression of the seal member can be suppressed.

Details of Embodiments of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

Figure 5:
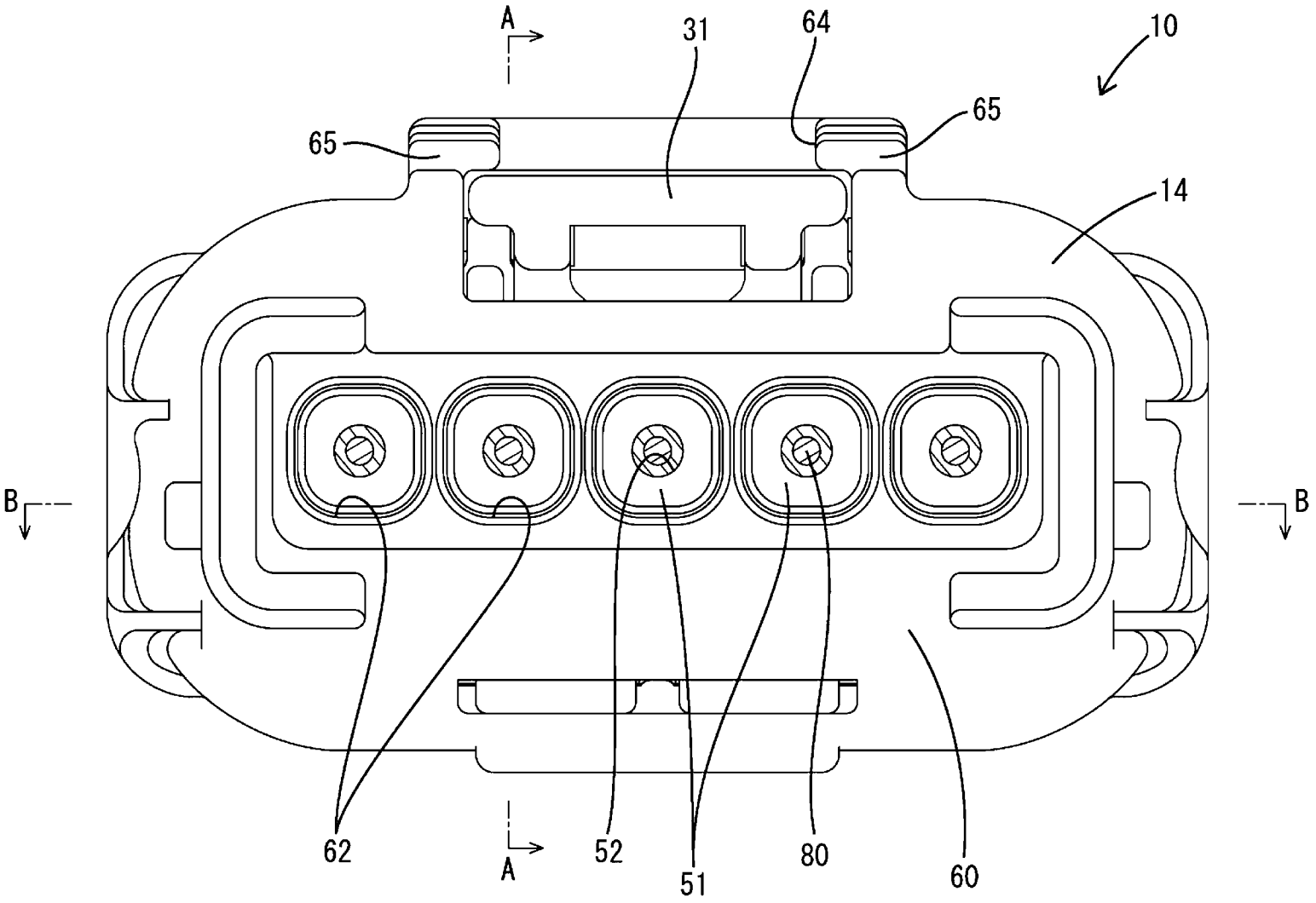
FIG. 5 is a back view of the connector of the one embodiment connected to the mating connector.
Figure 6:
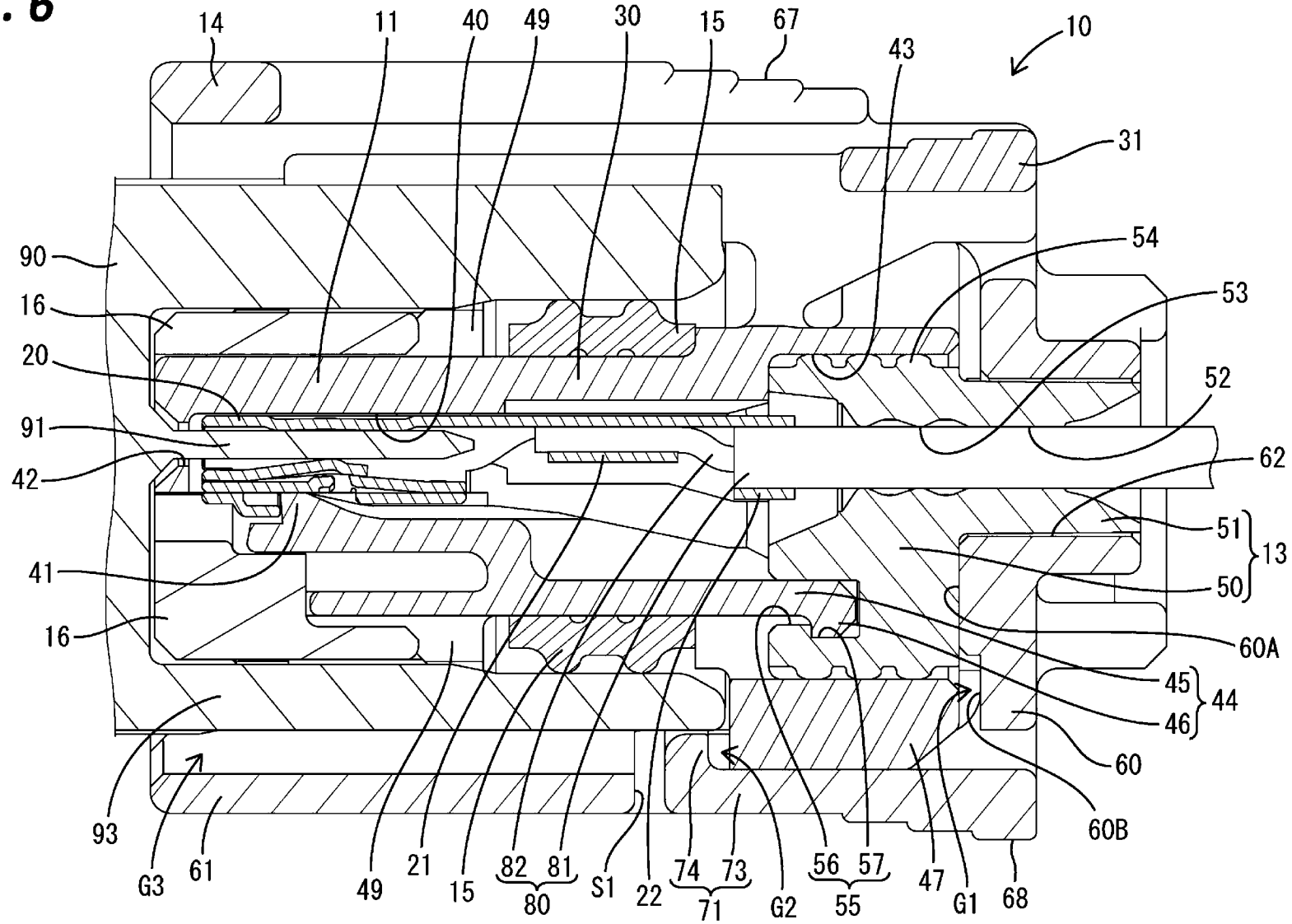
FIG. 6 is a section along A-A of FIG. 5.

A connector 10 to be connected to a mating connector 90 is illustrated in one embodiment (see FIG. 6). The mating connector 90 is, for example, provided in a device such as an engine. Note that, in the following description, a side of the connector 10 facing the mating connector 90 is referred to as a front side and an opposite side thereof is referred to as a rear side. A vertical direction shown in FIGS. 3, 5, 6 and 8 is directly defined as a vertical direction. A lateral direction when the connector 10 is viewed from front is defined as a lateral direction.

The connector 10 is a waterproof connector. As shown in FIG. 1, the connector 10 includes terminal fittings 11, a housing 12, a seal member 13, a mounting member 14, a seal ring 15 and a front member 16.

The terminal fitting 11 is formed, such as by bending a conductive metal plate. As shown in FIGS. 1 and 6, the terminal fitting 11 is a female terminal fitting and includes a body portion 20, a wire barrel 21 and an insulation barrel 22. The body portion 20 has a tubular shape (in particular, a rectangular tube shape) open in a front-rear direction. When the connector 10 is connected to the mating connector 90, a tab 91 of the mating connector 90 is connected to the body portion 20. The wire barrel 21 is arranged behind the body portion 20. The wire barrel 21 is crimped to a conductor 82 exposed from a wire 80 by removing a coating 81. The insulation barrel 22 is arranged behind the wire barrel 21. The insulation barrel 22 is crimped to the wire 80. In this way, the wire 80 is connected to a rear end side of the terminal fitting 11.

The housing 12 is made of synthetic resin. As shown in FIG. 1, the housing 12 includes a housing body 30 and a lock arm 31 provided on a side surface (upper surface in this embodiment) of the outer periphery of the housing body 30. The lock arm 31 includes a supporting portion 32 rising from the upper surface of the housing body 30. The lock arm 31 includes a pair of left and right arm portions 33 connected to both left and right sides of the upper end of the supporting portion 32 and extending forward and rearward. The lock arm 31 includes a connector lock portion 34 coupling lower end sides of the pair of arm portions 33 to each other on a side in front of the supporting portion 32. The lock arm 31 includes a releasing portion 35 coupling upper end sides of the pair of arm portions 33 on a side behind the supporting portion 32. The upper surface of the releasing portion 35 is formed into a step shape to be higher toward a rear side.

Figure 8:
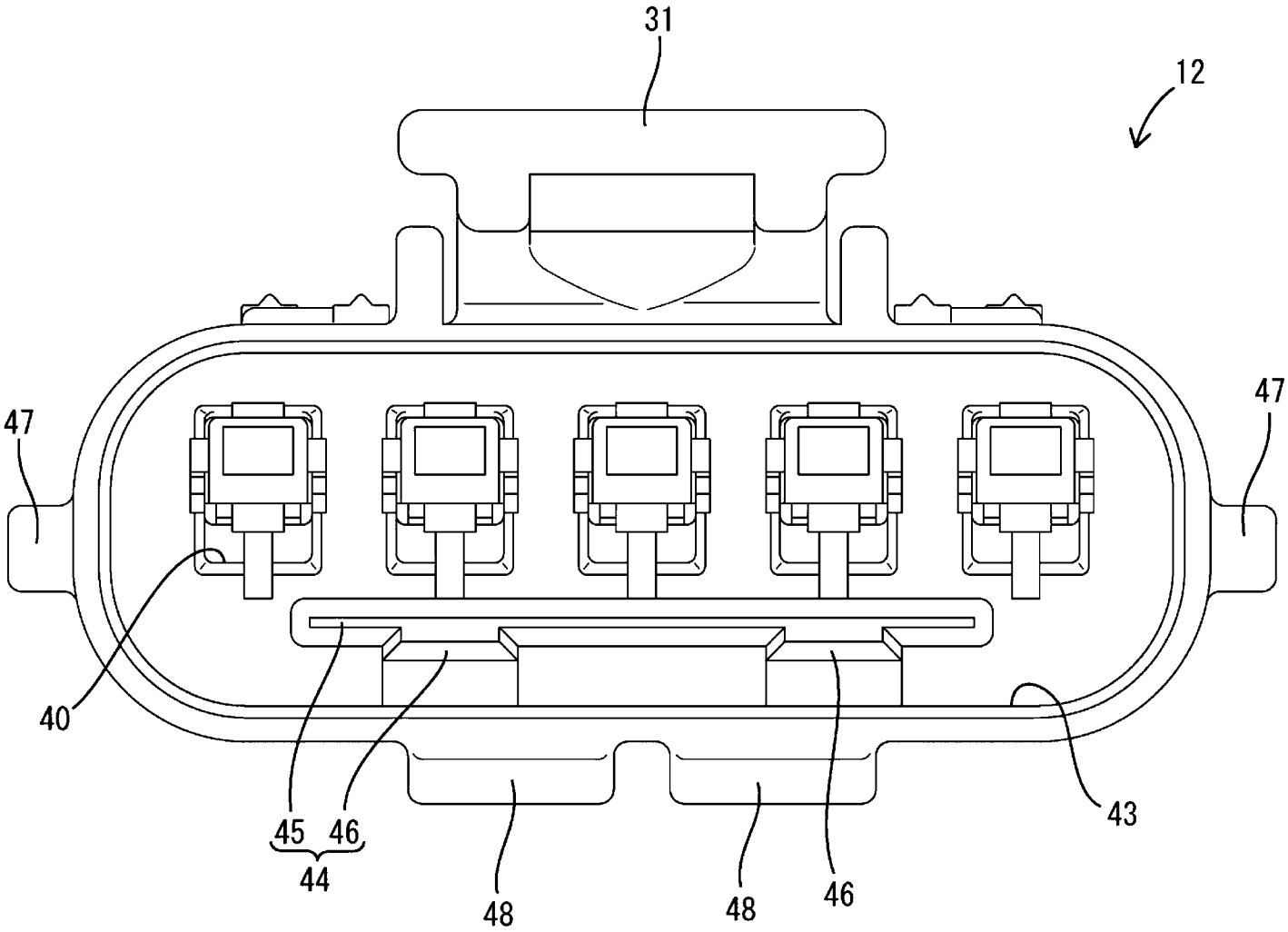
FIG. 8 is a back view of a housing of the one embodiment.

As shown in FIG. 1, the housing body 30 is shaped to be longer in the lateral direction than in the vertical direction. As shown in FIG. 6, the housing body 30 includes cavities 40 extending in the front-rear direction. As shown in FIG. 8, a plurality of (five in this embodiment) of the cavities 40 are provided side by side in the lateral direction.

As shown in FIG. 6, the housing body 30 includes locking lances 41 projecting into the cavities 40 from lower sides of the cavities 40. Tip sides of the locking lances 41 can be deflected and deformed. The terminal fitting 11 is inserted from behind the housing body 30 and arranged in the cavity 40 while deflecting the locking lance 41, and a rearward displacement thereof is restricted by the resiliently returned locking lance 41.

As shown in FIG. 6, the housing body 30 includes tab insertion holes 42 on front sides of the cavities 40. The tab insertion hole 42 is open in the front-rear direction and communicates with the cavity 40. The tab 91 of the mating connector 90 is inserted into the cavity 40 via the tab insertion hole 42 and connected to the terminal fitting 11 arranged in the cavity 40.

As shown in FIG. 6, the housing body 30 includes an accommodation recess 43 open in the rear surface of the housing body 30. The accommodation recess 43 is formed by recessing the rear surface of the housing body 30. An internal space of the accommodation recess 43 communicates with rear end parts of the respective cavities 40. The seal member 13 is arranged in the accommodation recess 43.

As shown in FIGS. 6 and 8, the housing body 30 includes a locking portion 44 to be locked to the seal member 13. The locking portion 44 includes a rearward projecting portion 45 projecting rearward from the back surface of the accommodation recess 43 and locking claw portions 46 projecting downward from a rear end side of the rearward projecting portion 45. The rear end of the rearward projecting portion 45 is arranged in front of a rear opening end of the accommodation recess 43. The rearward projecting portion 45 extends in the lateral direction. A width of the locking claw portion 46 is smaller than that of the rearward projecting portion 45. Two locking claw portions 46 are provided at an interval in the lateral direction.

Figure 7:
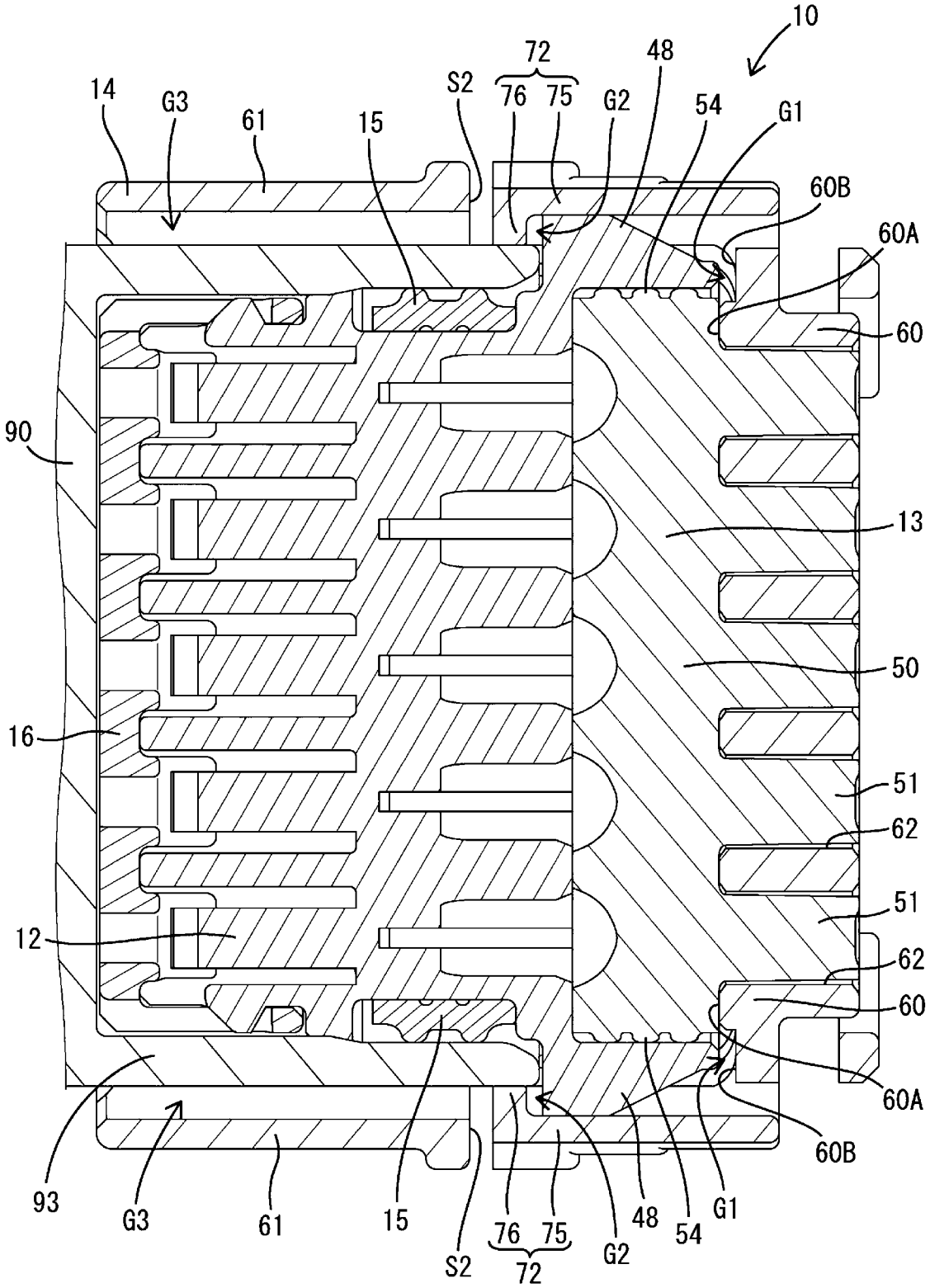
FIG. 7 is a section along B-B of FIG. 5.

As shown in FIGS. 6 and 7, the housing 12 includes a first engagement receiving portion 47 and second engagement receiving portions 48 to be engaged with the mounting member 14. The first engagement receiving portion 47 projects downward from the lower surface of the accommodation recess 43. The second engagement receiving portions 48 project laterally outward from both left and right side surfaces of the accommodation recess 43. Each of the rear surfaces of the first and second engagement receiving portions 47, 48 is inclined to reduce a projection dimension toward a rear end. Each of the front surfaces of the first and second engagement receiving portions 47, 48 is arranged along the vertical direction.

As shown in FIGS. 1 and 6, the housing 12 includes rattling preventing ribs 49. The rattling preventing ribs 49 are provided on the top and bottom of the housing body 30. The upper rattling preventing ribs 49 project upward on an upper end side of the housing body 30. The lower rattling preventing ribs 49 project downward on a lower end side of the housing body 30.

Figure 9:
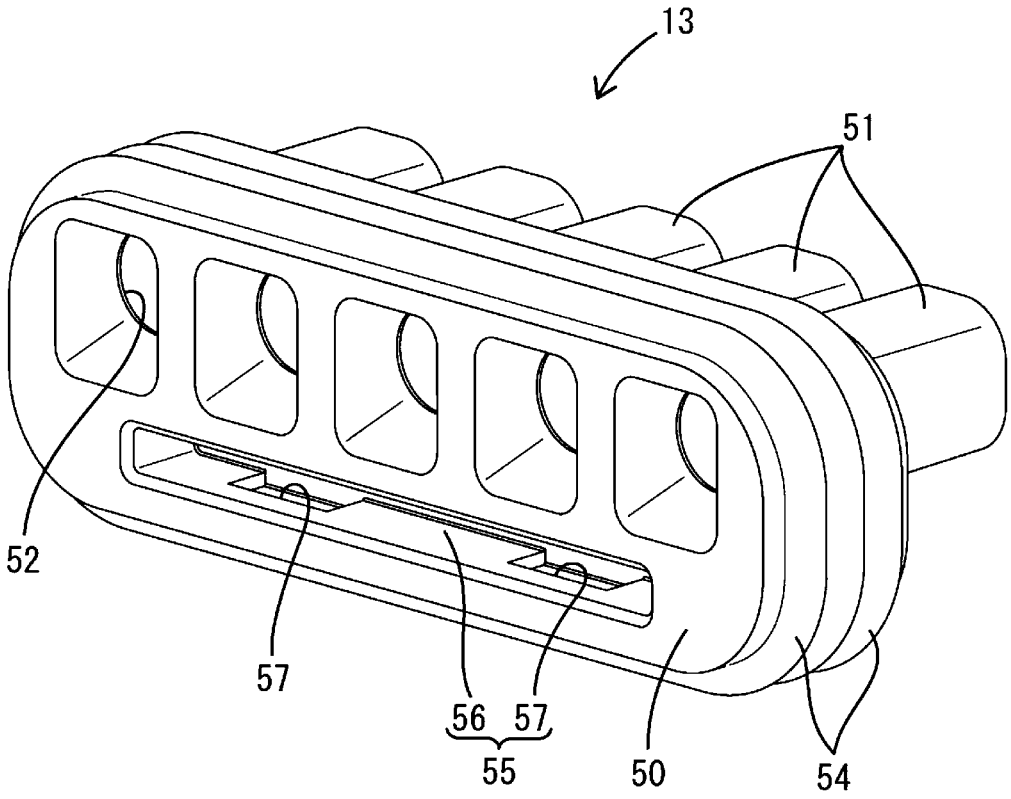
FIG. 9 is a perspective view of a seal member of the one embodiment.

The seal member 13 is made of rubber and configured as a one-piece rubber plug for sealing a plurality of the wires 80. As shown in FIGS. 6, 7 and 9, the seal member 13 includes a seal body 50 through which the plurality of wires 80 are passed, and tube portions 51 projecting rearward from the rear surface of an upper part of the seal body 50 to individually surround the respective wires 80. The seal body 50 is shaped to be long in the lateral direction in a front view. The seal body 50 includes seal holes 52 through which the respective wires 80 are passed in a liquid-tight manner. The seal holes 52 are provided to individually correspond to the respective wires 80 and penetrate through the seal body 50 and the tube portions 51. An inner peripheral lip 53 extending over the entire periphery in a circumferential direction is formed on the inner peripheral surface of the seal hole 52. The inner peripheral lip 53 is arranged only on the side of the seal body 50 and not arranged on the side of the tube portion 51. Outer peripheral lips 54 extending over the entire periphery in a circumferential direction are formed on the outer peripheral surface of the seal body 50.

As shown in FIGS. 6 and 9, the seal body 50 includes a lock receiving portion 55 to be locked by the locking portion 44 of the housing 12. The lock receiving portion 55 is arranged below the seal holes 52. The lock receiving portion 55 includes a groove portion 56 open in the front surface of the seal body 50 and locking recesses 57 formed in the back surface of the groove portion 56.

As shown in FIG. 5, the tube portions 51 are arranged side by side in a row in a width direction on the rear surface of the seal body 50. The tube portion 51 is in the form of a tube having a rear part of the seal hole 52 formed inside and has four rounded corner parts in a back view. No lip is formed on the inner and outer peripheral surfaces of the tube portion 51.

As shown in FIG. 6, the mounting member 14 is a member for sandwiching the seal member 13 between the housing 12 and the mounting member 14. The mounting member 14 includes a rear wall 60 arranged along the vertical and lateral directions and a tubular outer wall 61 projecting forward from an outer peripheral end part of the rear wall 60.

As shown in FIGS. 6 and 7, the rear wall 60 includes a plurality of through holes 62 penetrating in the front-rear direction. The through holes 62 are provided to individually correspond to the respective tube portions 51 of the seal member 13, and the tube portions 51 are arranged in a fit state inside. The rear wall 60 has a seal restricting surface 60A and a housing restricting surface 60B on a front surface. The seal restricting surface 60A restricts a rearward displacement of the seal member 13. The housing restricting surface 60B is arranged behind the seal restricting surface 60A to restrict a rearward displacement of the accommodation recess 43 in the housing 12.

Figure 2:
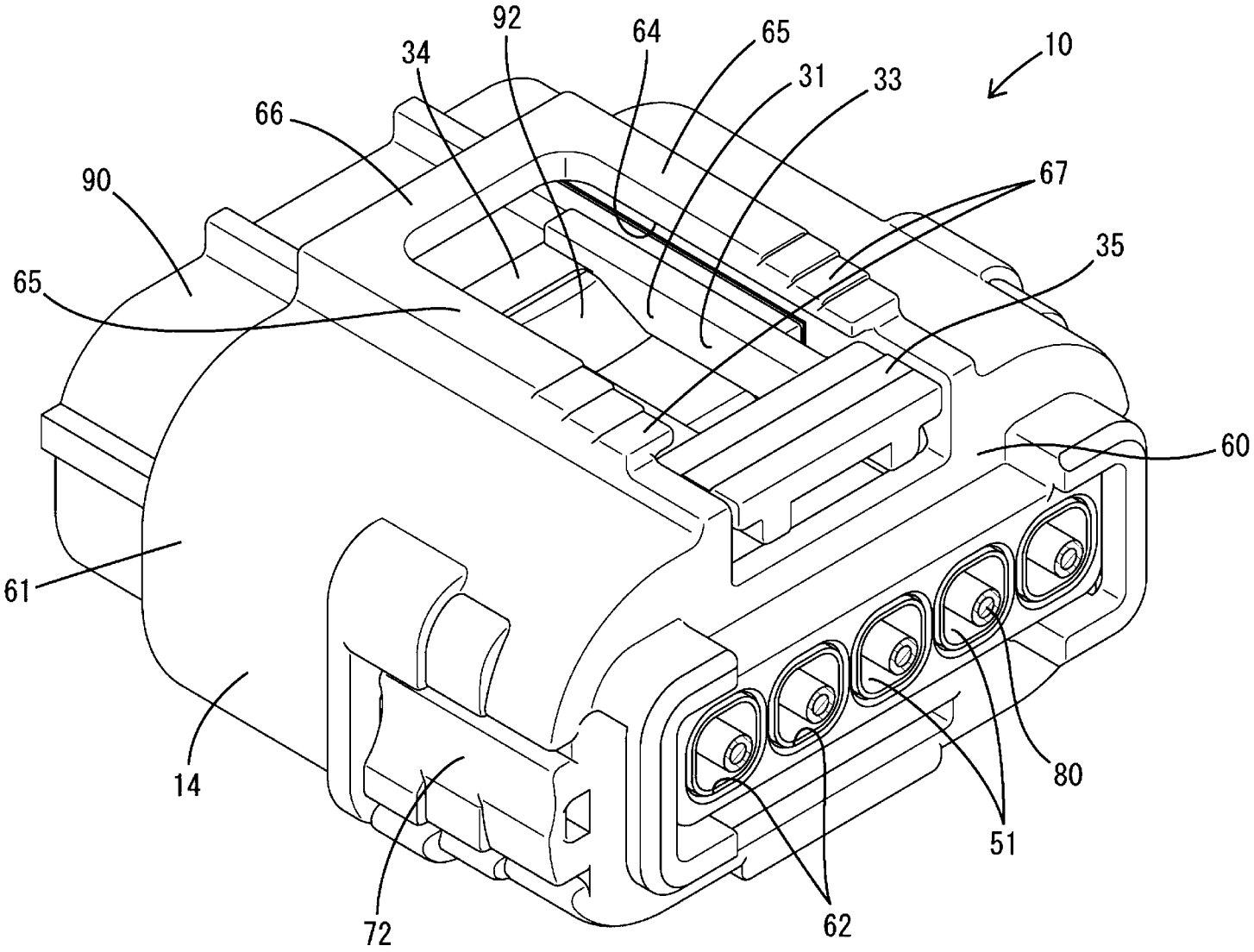
FIG. 2 is a perspective view of the connector of the one embodiment connected to the mating connector.

As shown in FIG. 2, the outer wall 61 includes an opening 64 for exposing the upper surface of the lock arm 31, protection walls 65 arranged on both sides across the opening 64 to cover the lock arm 31 from the both sides, and a bridge portion 66 arranged in front of the opening 64 and coupling front end sides of the protection walls 65 on both sides to each other. The protection wall 65 has an upper step portion 67, the height position of which becomes higher in a stepwise manner toward a front side, on the upper surface of a rear end side. The front ends of the upper step portions 67 are arranged forward of the front end of the releasing portion 35 of the lock arm 31 with the mounting member 14 assembled with the housing 12. As shown in FIG. 6, the outer wall 61 includes a lower step portion 68, a downward projection amount of which is increased toward a rear side, on the lower surface of a rear end side.

Figure 3:
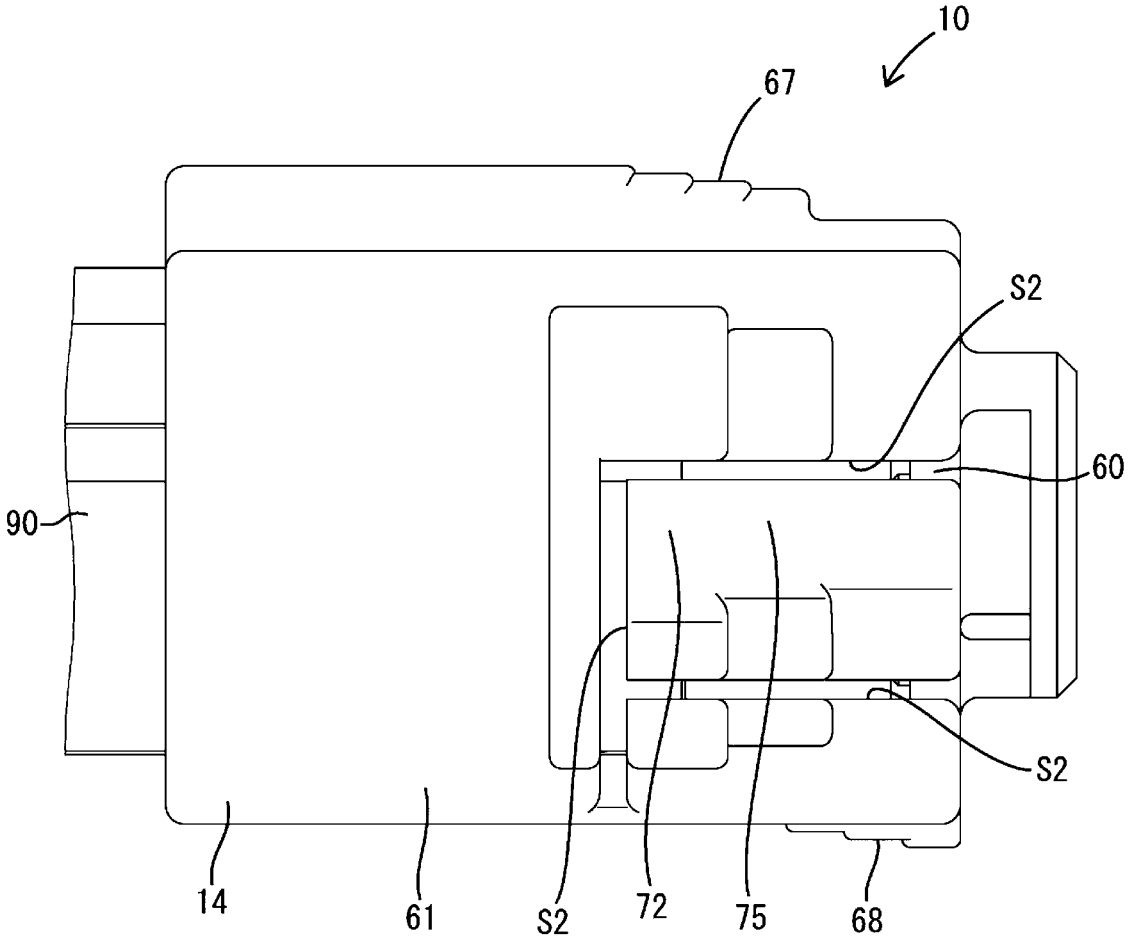
FIG. 3 is a side view of the connector of the one embodiment connected to the mating connector.
Figure 4:
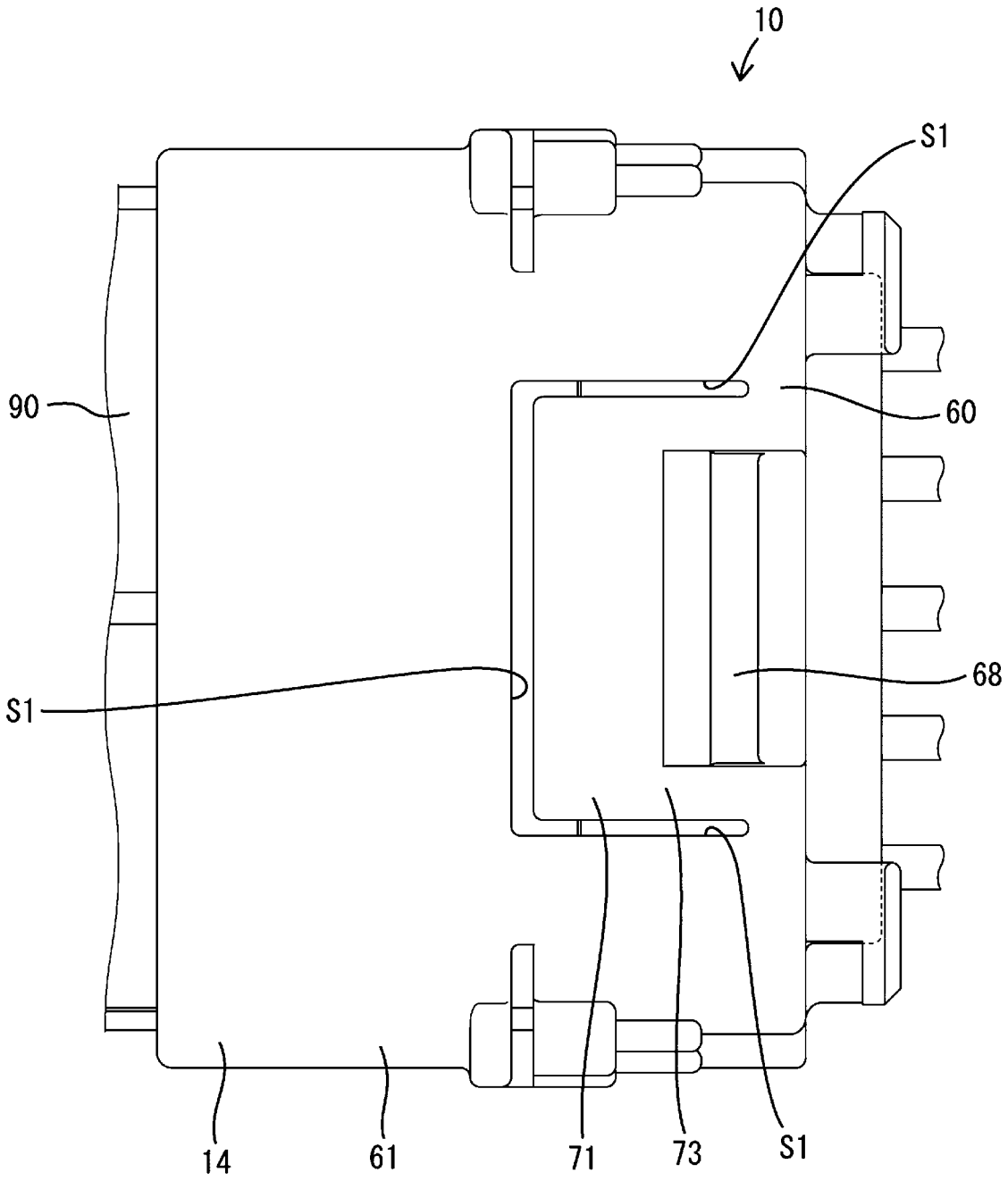
FIG. 4 is a bottom view of the connector of the one embodiment connected to the mating connector.

As shown in FIGS. 3 and 4, the mounting member 14 includes a first engaging portion 71 and second engaging portions 72 to be engaged with the housing 12. The first and second engaging portions 71, 72 are arranged to be deflectable and deformable in parts where the outer wall 61 is cut.

As shown in FIG. 6, the first engaging portion 71 includes a first plate portion 73 projecting forward from the front surface of a lower end side of the rear wall 60 and a first engaging claw portion 74 projecting upward from a front end side of the first plate portion 73. As shown in FIG. 4, the first plate portion 73 has a rectangular shape long in the lateral direction in a bottom view. First slits 51 are formed between both left and right sides and a front side of the first engaging portion 71 and the outer wall 61. Thus, even if the first engaging portion 71 is deflected and deformed, the first engaging portion 71 does not interfere with the outer wall 61.

As shown in FIG. 7, the second engaging portions 72 include second plate portions 74 projecting forward from the front surfaces of both left and right sides of the rear wall 60 and second engaging claw portions 76 projecting laterally inward from front end sides of the second plate portions 75. As shown in FIG. 3, the second plate portion 75 has a rectangular shape long in the front-rear direction in a side view. Second slits S2 are formed between both upper and lower sides and a front side of the second engaging portion 72 and the outer wall 61. Thus, even if the second engaging portion 72 is deflected and deformed, the second engaging portion 72 does not interfere with the outer wall 61.

The seal ring 15 is made of rubber and, as shown in FIG. 1, has an annular shape. Lips are formed over the entire periphery in a circumferential direction on the outer peripheral surface of the seal ring 15. The seal ring 15 is mounted on the outer peripheral surface of the housing body 30.

The front member 16 is made of synthetic resin and functions as a front retainer. As shown in FIG. 6, the front member 16 is mounted on a front side of the housing body 30 to restrict the deflection and deformation of the locking lances 41. In this way, rearward escape of the terminal fittings 11 is more reliably prevented.

Next, functions and effects of the connector 10 are described.

As shown in FIG. 6, the seal body 50 of the seal member 13 is accommodated into the accommodation recess 43 of the housing 12. The locking portion 44 of the housing 12 is locked to the lock receiving portion 55 of the seal member 13, whereby the separation of the seal member 13 from the housing 12 is restricted. Further, the tube portions 51 are arranged to project rearward from the accommodation recess 43.

Subsequently, the mounting member 14 is mounted on the housing 12 from behind. In mounting the mounting member 14 on the housing 12, the first engaging portion 71 of the mounting member 14 is pressed from below by the first engagement receiving portion 47 of the housing 12 to be deflected and deformed. When moving further forward, the first engaging portion 71 resiliently returns to engage the first engagement receiving portion 47. A forward displacement of the first engagement receiving portion 47 is restricted by the first engaging claw portion 74 of the first engaging portion 71.

Further, front end sides of the second engaging portions 72 of the mounting member 14 are pressed laterally outward by the second engagement receiving portions 48 of the housing body 12 to be deflected and deformed as shown in FIG. 7. When moving further forward, these front end sides resiliently return to engage the second engagement receiving portions 48. Forward displacements of the second engagement receiving portions 48 are restricted by the second engaging claw portions 76 of the second engaging portions 72.

Subsequently, the terminal fittings 11 are inserted into the cavities 40. As shown in FIG. 6, each wire 80 is passed through each seal hole 52 of the seal member 13 in a liquid-tight manner.

The first engaging portion 71 is engaged with the first engagement receiving portions 47 and the second engaging portions 72 are engaged with the second engagement receiving portions 48, whereby the mounting member 14 is mounted on the housing 12. With the mounting member 14 mounted on the housing 12, the seal body 50 is arranged in the accommodation recess 43 and a lower part of the seal body 50 is held by being sandwiched in the front-rear direction by the back surface of the accommodation recess 43 and the front surface of the rear wall 60 of the mounting member 14 as shown in FIG. 6. That is, the front surface of the lower part of the seal body 50 and the back surface of the accommodation recess 43 are in contact, and the rear surface of the lower part of the seal body 50 and the seal restricting surface 60A are in contact. A rearward displacement of the lower part of the seal body 50 is restricted by the seal restricting surface 60A, and a rearward displacement of the accommodation recess 43 accommodating the seal body 50 is restricted by the housing restricting surface 60B arranged behind the seal restricting surface 60A.

As shown in FIGS. 6 and 7, the housing restricting surface 60B is arranged rearward of the seal restricting surface 60A while a gap G1 is formed between the housing 12 and the housing restricting surface 60B. Further, when the seal member 13 is in a natural state, gaps G2 are formed between the first engaging claw portion 74 of the first engaging portion 71 and the first engagement receiving portion 47 and between the second engaging claw portions 76 of the second engaging portions 72 and the second engagement receiving portions 48. Thus, the mounting member 14 is allowed to be inclined with respect to the housing 12.

Further, the tube portions 51 projecting rearward from the upper part of the seal body 50 are arranged in the through holes 62 of the mounting member 14. In the above way, the connector 10 is manufactured.

The connector 10 is connected to the mating connector 90 not to be relatively displaced. The connector 10 is retained with respect to the mating connector 90 by the connector lock portion 34 of the lock arm 31 locking a connector lock receiving portion 92 of the mating connector 90. When the connector 10 is connected to the mating connector 90, the terminal fittings 11 are connected to the tabs 91 of the mating connector 90. A receptacle 93 of the mating connector 90 is arranged between the housing 12 and the outer wall 61 of the connector 10. The projecting ends of the rattling preventing ribs 49 of the housing 12 in the connector 10 are vertically facing the inner peripheral surface of the receptacle 93 of the mating connector 90. Thus, vertical rattling of the housing 12 with respect to the mating connector 90 can be suppressed. Further, a gap G3 is formed between the inner peripheral surface of the outer wall 61 of the connector 10 and the outer peripheral surface of the receptacle 93 of the mating connector 90. Thus, the mounting member 14 is allowed to be vertically inclined with respect to the mating connector 90.

Further, with the connector 10 connected to the mating connector 90, the upper surface of the lock arm 31 of the housing 12 is exposed via the opening 64 of the mounting member 14 and both left and right sides of the lock arm 31 are covered by the protection walls 65 of the mounting member 14. Thus, the lock arm 31 is protected by the protection walls 65 and less likely to interfere with external matters. Therefore, the lock arm 31 can be prevented from being inadvertently released.

During use, the vibration of the wire 80 may be transmitted to the connector 10. The mounting member 14 is in contact with the wire 80 via the seal member 13. Thus, the vibration of the wire 80 is transmitted to the mounting member 14 via the seal member 13. However, since the mounting member 14 is movable with respect to the housing 12, the vibration transmitted to the mounting member 14 is less likely to be transmitted to the housing 12. Specifically, the gaps G1, G2 are formed between the mounting member 14 and the housing 12. Further, the gap G3 is also formed between the mounting member 14 and the mating connector 90 connected to the housing 12. Thus, if the wire 80 vibrates in the vertical and/or lateral direction, the mounting member 14 enters the gaps G1, G2 and G3 and the rear end side of the mounting member 14 is inclined in the vertical and/or lateral direction with respect to the housing 12. Thus, the vibration transmitted to the mounting member 14 is less likely to be transmitted to the housing 12. Therefore, the vibration of the wire 80 to be transmitted to the housing 12 can be suppressed.

Particularly, the seal member 13 includes the tube portions 51 individually corresponding to the respective wires 80, and the respective wires 80 are passed through the seal holes 52 in the respective tube portions 51 in a liquid-tight manner. If the wire 80 vibrates, the outer peripheral surface of the tube portion 51 individually holding the wire 80 swings and contacts the inner peripheral surface of the through hole 62. Further, the rear surface of the lower part of the seal body 50 is also in contact with the seal restricting surface 60A. Thus, the vibration of the wire 80 is efficiently transmitted to the mounting member 14 via the tube portion 51. In this way, the vibration of the wire 80 to be transmitted to the housing 12 via the seal member 13 is reduced. Further, the vibration transmitted to the mounting member 14 via the tube portion 51 is less likely to be transmitted to the housing 12 as described above. Thus, the vibration of the wire 80 to be transmitted to the housing 12 can be further suppressed. Note that although the outer peripheral surface of the tube portion 51 is not in contact with the inner peripheral surface of the through hole 62 of the mounting member 14 in a state where the wire 80 is not vibrating in this embodiment, these peripheral surfaces may be in contact before vibration.

Further, the first and second engaging portions 71, 72 are deflectable and deformable during the vibration of the wire 80. Thus, by the deflection and deformation of the first and second engaging portions 71, 72 during the vibration of the wire 80, vibration is less likely to be transmitted between the first engaging portion 71 and the first engagement receiving portion 47 or between the second engaging portions 72 and the second engagement receiving portions 48. Therefore, the vibration transmitted to the mounting member 14 via the seal member 13 is even less likely to be transmitted to the housing 12, with the result that the vibration of the wire 80 to be transmitted to the housing 12 can be further suppressed.

Other Embodiments of Present Disclosure

The embodiment disclosed this time should be considered illustrative in all aspects, rather than restrictive.

(1) Although the seal member includes the tube portions in the above embodiment, the seal member may not include the tube portions.

(2) Although the protection walls are provided in the above embodiment, the protection walls may not be provided.

(3) Although the locking portion and the lock receiving portion to be locked to each other are provided in the above embodiment, the locking portion and the lock receiving portion may not be provided.

(4) Although only the engaging portions, out of the engaging portions and the engagement receiving portions, are deflectable and deformable during the vibration of the wire in the above embodiment, only the engagement receiving portions may be deflectable and deformable, the both may be deflectable and deformable or neither of the both may be deflectable and deformable.

(5) Although no lip is provided on the inner peripheral surface of the tube portion in the above embodiment, lip(s) may be provided on the inner peripheral surface of the tube portion.

(6) Although the housing restricting surface is provided in the above embodiment, the housing restricting surface may not be provided.

(7) Although the seal member is a one-piece rubber plug for collectively sealing the plurality of wires in the above embodiment, the seal member may be a rubber plug for sealing only one wire.

(8) The front-rear direction may be inclined with respect to a horizontal direction or may be a vertical direction during the use of the connector.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a terminal fitting configured to be connected to a wire;

a housing configured to accommodate the terminal fitting and including a locking portion configured to project rearward within an accommodation recess of the housing;

a seal member including a seal hole positioned on a front surface of the seal member and a groove positioned on the front surface of the seal member, the wire being passed through the seal hole in a liquid-tight manner, and the groove being configured to receive the locking portion for restricting separation of the seal member from the housing by being locked by the locking portion; and a mounting member including an outer wall and configured to hold the seal member by sandwiching the seal member between the housing and the mounting member, the mounting member configured to be in contact with the seal member and movably mounted on the housing.

2. The connector of claim 1, wherein the seal member includes a tube portion, the seal hole is formed in the tube portion, and the mounting member includes a through hole to be held in contact with an outer peripheral surface of the tube portion.

3. The connector of claim 1, wherein the housing includes a lock arm on a side surface of an outer periphery, the lock arm locking a mating connector in a connected state, the outer wall of the mounting member covers the side surface of the housing, and the outer wall includes an opening for exposing the lock arm and protection walls arranged on both sides across the opening to cover the lock arm from the both sides.

4. The connector of claim 1, wherein the housing includes an engaging portion, the mounting member includes an engagement receiving portion, and at least one of the engaging portion and the engagement receiving portion is deflectable and deformable during vibration of the wire.

5. The connector of claim 1, wherein:

the mounting member includes a rear wall for sandwiching the seal member between the housing and the rear wall, the rear wall has, on a front surface, a seal restricting surface for restricting a rearward displacement of the seal member and a housing restricting surface for restricting a rearward displacement of the housing, and the housing restricting surface is arranged rearward of the seal restricting surface.

6. The connector of claim 1, wherein the locking portion includes a locking claw configured to be locked by a locking recess formed in a back surface of the groove.

* * * * *